United States Patent [19]

Schmidt

[11] Patent Number: 4,771,586

[45] Date of Patent: Sep. 20, 1988

[54] GRATING BAR FOR FLOOR MATS

[75] Inventor: Achim D. Schmidt, Wrist, Fed. Rep. of Germany

[73] Assignee: Alveru AG, Fribourg, Switzerland

[21] Appl. No.: 944,809

[22] Filed: Dec. 19, 1986

[30] Foreign Application Priority Data

Dec. 20, 1985 [DE] Fed. Rep. of Germany ... 8535896[U]

[51] Int. Cl.[4] ..... A47L 23/24; A47G 27/02

[52] U.S. Cl. ..... 52/664; 15/202; 15/217; 15/238

[58] Field of Search ..... 52/664–667, 52/177, 180; 160/231 R; 428/52; 273/195 A; 15/202, 217, 238

[56] References Cited

U.S. PATENT DOCUMENTS

| | | | |
|---|---|---|---|
| 945,575 | 1/1910 | McPherson | 52/667 |
| 3,451,683 | 6/1969 | Oliver | 273/195 A |
| 3,467,391 | 9/1969 | Elesh | 273/195 A |
| 3,913,291 | 10/1975 | Dulien et al. | 52/666 |

FOREIGN PATENT DOCUMENTS

| | | | |
|---|---|---|---|
| 7239290 | 3/1973 | Fed. Rep. of Germany . | |
| 1411916 | 10/1975 | United Kingdom . | |
| 2080105 | 2/1982 | United Kingdom | 15/238 |

*Primary Examiner*—James L. Ridgill, Jr.
*Attorney, Agent, or Firm*—Becker & Becker, Inc.

[57] ABSTRACT

A grating bar for floor mats. The bar has two legs that form the walls of a U-shaped profiled strip. Cleaning elements are disposed between these walls, and the latter are provided with openings for holding elements. Provided on the outer surfaces of the walls, between the openings and the free ends of the legs, are projections that can be united to form an element that extends over the entire length of the bar.

4 Claims, 1 Drawing Sheet

GRATING BAR FOR FLOOR MATS

BACKGROUND OF THE INVENTION

1. Field of the Invention

The present invention relates to a grating bar for floor mats. The bar forms the walls of a U-shaped profiled strip. Cleaning elements, for example in the form of plastic cleats, strips of bristles, etc. can be disposed between these walls. Furthermore, each of the walls is provided with openings for holding means.

2. Description of the Prior Art

From German Gebrauchsmuster No. 7 239 290 disclosed Mar. 15, 1973 as well as corresponding British patent specification No. 1,411,916-Schmidt published Oct. 29, 1975, each belonging to the assignee of the present invention, it is known, via a cable, to join grating bars of this general type, accompanied by the interposition of spacers of rubber or plastic, to form a floor mat. The cable imparts a flexibility to the foot grating that is held securely together by the cable. This flexibility considerably simplified handling of the grating, which is, for example, in the form of a mat in a stiff frame over a pit or other recessed area, when such a pit is emptied. Unfortunately, during use of such a floor mat, a roll-up effect occurs whereby the grating bars along the edges lift up from the support surfaces and represent a source of danger for accidents, since they can be tripped over.

An object of the present invention therefore is to provide a floor mat, comprised of grating bars that are equipped with cleaning elements and that are disposed on a flexible holding element accompanied by the interposition of spacers, which floor mat, without adversely affecting its flexibility, is embodied in such a way that even after a long period of use, all of the grating bars can be reliably held on the ground or floor.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

The grating bar of the present invention comprises: a profiled strip that has a U-shaped cross-sectional shape, including two legs, each of which has a first free end and an opposite second end, with the second ends of the two legs being interconnected by a base, with each of the legs having an outer surface that faces away from the other leg, an inner surface that faces the other leg, whereby cleaning elements can be disposed between these legs, each of which is also provided with openings for holding means; and at least one projection provided on the outer surface of each of the legs, with this projection being disposed between the openings and the free end of that leg. Each of these projections is advantageously in the form of a bead.

Due to these inventive projections, which are provided on the grating bars between the openings for the holding means and the free ends of the legs, between which the cleaning elements are disposed, floor mats composed of these grating bars can easily be provided where the grating bars rest at a slight angle against the spacers, in other words the spacers exert a displacement force against the grating bars, as a result of which the grating has a tendency to impart a slightly raised curvature to its work surface, and in particular presses the end bars against the support surfaces.

With such floor mats, the space between the grating bars serves for receiving the dirt that results when the shoes or boots are cleaned, unless the floor mat is disposed over a pit. For a floor mat that is placed directly on the floor or ground, the space between the individual grating bars is therefore critical for the size of the space that is available for collecting dirt. This space must not be too great, because otherwise the heels of modern shoes, for example spiked heels, can become wedged in the gaps between the grating bars. It has therefore been shown to be advantageous, pursuant to one specific embodiment of the present invention, to join the projections on the outer surface of a given one of the grating bars to form an element that extends over the entire length of the bar. As a result of this element, the gap between the grating bars of a floor mat is reduced and a support surface is provided for small or narrow shoe or boot heels without thereby appreciably reducing the space that is available for collecting dirt.

Further specific features of the present invention will be described in detail subsequently.

DESCRIPTION OF THE PREFERRED EMBODIMENTS

Figure 1:
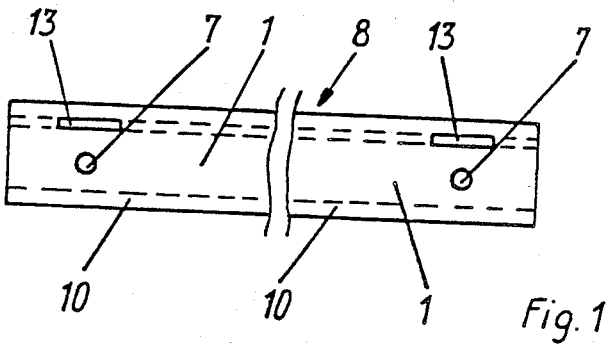
FIG. 1 is a side view of one exemplary embodiment of the inventive grating bar.

Referring now to the drawing in detail, the inventive grating bar 8 comprises two legs or walls 1 and 2 which, via a base 10, are joined to form a U-shaped profiled strip. The walls 1 and 2 are provided with openings 7 in the form of holes. Provided on the outer surfaces of the walls 1 and 2 are projections 13 that are disposed between the holes 7 and the free upper ends of the walls 1 and 2. These projections 13 could also be embodied as elements that extend over the entire length of the grating bar 8; such an embodiment is indicated by dashed lines in FIG. 1.

Figure 2:
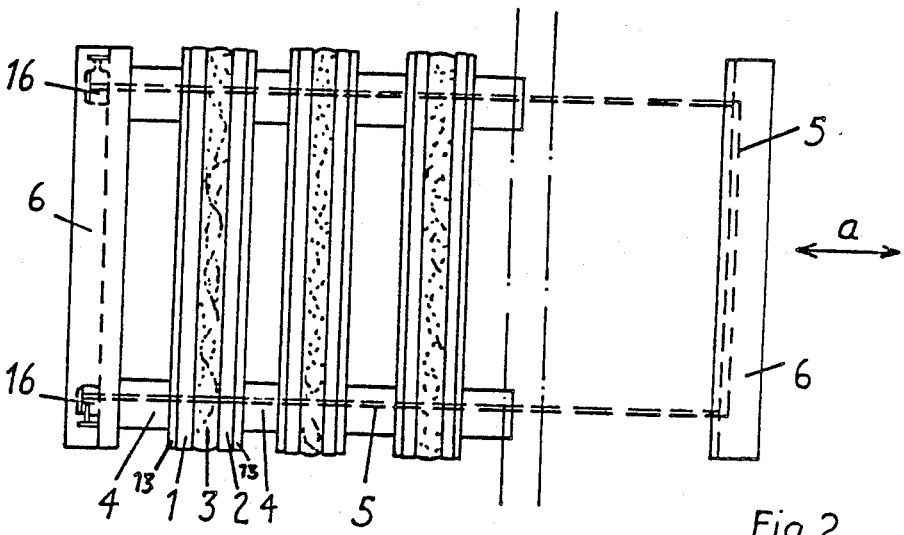
FIG. 2 is a plan view of a floor mat composed of the inventive grating bars.
Figure 3:
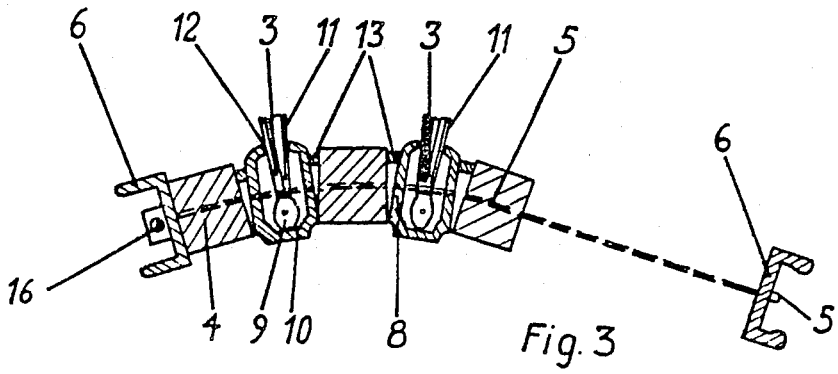
FIG. 3 is a cross-sectional view through the floor mat of FIG. 2.

The floor mat schematically illustrated in FIGS. 2 and 3 comprises a number of grating bars 8 that are disposed at right angles to the direction of travel, which is indicated by the double arrow "a" in FIG. 2. The grating bars 8 are in the form of U-shaped profiled strips. Disposed in the space between the walls 1 and 2 of each grating bar 8 is a raised strip of bristles 3 that has the same length as does the grating bar 8. This length determines the width of the floor mat. The bulbs or bases 9 of a given strip of bristles 3 rest upon the base 10 of the grating bar, with the tips 11 of the bristles extending through a continuous slot 12 that is provided between the walls 1 and 2 of the grating bar 8. The tips 11 extend through the slot 12 to such an extent that they can make contact with the shoes or boots of a person that steps on the floor mat, so that the shoes or boots can be cleaned. Respective resilient separators or spacers 4, for example of rubber or plastic, are disposed between each two grating bars 8. A flexible holding element, for example a continuous cable 5, holds together this arrangement of the floor mat. The cable 5 extends through the holes 17 into the grating bars 8 and the spacers 4. The cable 5 is disposed at such a height that it holds the bulbs 9 of the strips of bristles 3 in position against the bases 10 of the grating bars 8. The cable 5 also holds the two end strips 6 of the floor mat, with the ends of the cable being secured by bolts 16 or other securing means. Where the cable 5 is a single continuous cable, it is secured to only one of the end strips 6. However, it would also be possible to use two or more separate cables, with both ends of each cable being secured to each of the end strips 6.

The purpose of the projections 13 on the walls 1 and 2 of the grating bars 8 of a floor mat is to keep those portions of the walls 1 and 2 that are in the vicinity of the slots 12 further from the spacers 4 than are those regions of the walls in the vicinity of the bases 10, so that in the unstressed state, the floor mat is slightly curved, as shown in FIG. 3, and the end strips 6 can at all times be reliably held in contact against the floor. When someone steps on the floor mat, the latter rests flat against the floor and the projections 13 penetrate the resilient spacers 4. As a result, in the upper region of the floor mat, the distance between the grading bars 8 is reduced, and the projections 13 are so close together that they form a support surface for small or narrow heels, for example for women's shoes that have a stiletto or spiked heel. Thus, such heels cannot become wedges or stuck between the grating bars 8, so that floor mats comprised of the inventive grating bars can also be used, without danger, by people who are wearing such shoes.

The present invention is, of course, in no way restricted to the specific disclosure of the specification and drawing, but also encompasses any modifications within the scope of the appended claims.

What I claim is:

1. A grating bar, for floor mats having space available for collecting dirt and that can be walked upon safely due to flat placement thereof and due to elimination of danger of accidents by tripping over edge curling occurring with a roll-up effect whereby the grating bars along the edges thereof can lift up from the support surface, the improvement in combination therewith comprising:

a profiled strip that has an essentially U-shaped cross-sectional shape, including two legs, each of which has a first free end that is spaced from the free end of the other leg, and an opposite second end, with said second ends of said legs being interconnected by a base; each of said legs including an outer surface that faces away from the other leg, and an inner surface that faces the other leg;

cleaning element means disposed between said inner surfaces of said legs and projecting from the essentially U-shaped cross-sectional shape of said strip; each of said legs also being provided with openings for holding means; and means to prevent lifting of grating bars along the edges thereof including at least one projection provided on said outer surface of each of said legs and located only near said free end of that leg, with said projection being disposed between said openings and said free end of that leg, said projection being located laterally of said legs to hold the grating bar reliably on the support surface thereof for elimination of danger of accidents by tripping over edge curling occurring with the roll-up effect whereby the grating bars along the edges thereof would otherwise lift up from the support surface and also to extend adjacent to at least a portion of the space that is available for collecting dirt.

2. A grating bar in combination according to claim 1, in which said legs are provided with projections in the form of beads.

3. A grating bar in combination according to claim 1, in which each of said legs is provided with a single projection that extends over the entire length of said bar, said projection serving to reduce gap space adjacent thereto relative to the grating bar and also to provide a support surface for small or narrow shoe or boot heels without thereby appreciably reducing the space that is available for collecting dirt.

4. A floor mat comprised of a plurality of the grating bars of claim 1, with each of said grating bars being provided with cleaning element means, and with resilient spacers being disposed between adjacent ones of said grating bars; said grating bars and spacers are held together, to form said mat, via flexible holding means extending through said spacers and said openings of said legs of said grating bars.

* * * * *